US011671749B2

(12) United States Patent
Strunk

(10) Patent No.: US 11,671,749 B2
(45) **Date of Patent: *Jun. 6, 2023**

(54) AUDIO LOUDSPEAKER ARRAY AND RELATED METHODS

(71) Applicant: Endow Audio, LLC, Georgetown, KY (US)

(72) Inventor: David T. Strunk, Georgetown, KY (US)

(73) Assignee: Endow Audio, LLC, Georgetown, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/781,546

(22) Filed: Feb. 4, 2020

(65) Prior Publication Data

US 2020/0314514 A1 Oct. 1, 2020

Related U.S. Application Data

(60) Provisional application No. 62/826,134, filed on Mar. 29, 2019.

(51) Int. Cl.

| | |
|---|---|
| ***H04R 1/40*** | (2006.01) |
| ***H04R 3/12*** | (2006.01) |
| ***H04R 1/02*** | (2006.01) |

(52) U.S. Cl.

CPC ..... *H04R 1/403* (2013.01); *H04R 1/025* (2013.01); *H04R 1/026* (2013.01); *H04R 3/12* (2013.01); *H04R 2201/401* (2013.01); *H04R 2400/11* (2013.01)

(58) Field of Classification Search

CPC combination set(s) only.

See application file for complete search history.

(56) References Cited

U.S. PATENT DOCUMENTS

| | | | | |
|---|---|---|---|---|
| 2,602,860 A | | 7/1952 | Doubt | |
| 3,931,867 A | | 1/1976 | Janszen | |
| 4,357,490 A | | 11/1982 | Dickey | |
| 5,537,479 A | * | 7/1996 | Kreisel | H04R 1/02 381/89 |

(Continued)

FOREIGN PATENT DOCUMENTS

| | | |
|---|---|---|
| EP | 2692144 B1 | 2/2017 |
| JP | 4513765 B2 | 7/2010 |
| KR | 100836662 B1 | 6/2008 |

OTHER PUBLICATIONS

JBL Professional, "CBT Constant Beamwidth Technology" TN V.1 No.35 Oct. 2009, https://www.jblpro.com/ProductAttachments/CBT_Tech_Note_Vol1No35_091007.pdf.

(Continued)

*Primary Examiner* — Duc Nguyen
*Assistant Examiner* — Assad Mohammed
(74) *Attorney, Agent, or Firm* — Michael S. Hargis; Stites & Harbison PLLC

(57) ABSTRACT

An audio speaker includes a frame or manifold supporting a plurality of drivers electrically connected to operate in common acoustic phase. The plurality of drivers includes an inner group of drivers and an outer group of drivers at least partially surrounding the inner group of drivers and the outer group of drivers includes at least two drivers with at least one the two drivers being a rearward facing driver.

21 Claims, 16 Drawing Sheets

(56) References Cited

U.S. PATENT DOCUMENTS

| | | | | |
|---|---|---|---|---|
| 5,590,214 | A * | 12/1996 | Nakamura | H04R 1/403 381/89 |
| 5,812,685 | A * | 9/1998 | Fujita | H04R 1/403 181/144 |
| 6,801,631 | B1 | 10/2004 | North | |
| 6,961,438 | B1 | 11/2005 | Fujita | |
| 7,409,071 | B1 | 8/2008 | Bromer | |
| 9,762,999 | B1 | 9/2017 | Johnson et al. | |
| 10,149,046 | B2 | 12/2018 | Johnson et al. | |
| 2004/0240697 | A1 | 12/2004 | Keele | |
| 2005/0025319 | A1 | 2/2005 | Kawakami | |
| 2006/0153407 | A1 | 7/2006 | Keele et al. | |
| 2006/0233402 | A1* | 10/2006 | Inagaki | H04R 1/403 381/182 |
| 2007/0201711 | A1 | 8/2007 | Meyer et al. | |
| 2009/0238383 | A1 | 9/2009 | Meyer et al. | |
| 2012/0033834 | A1 | 2/2012 | Mellow et al. | |
| 2016/0205479 | A1* | 7/2016 | Tomar | H04R 9/063 381/398 |
| 2020/0213694 | A1* | 7/2020 | Kwiram | H04R 1/227 |

OTHER PUBLICATIONS

English machine translation of JP4513765.
English machine translation of KR100836662.

* cited by examiner

AUDIO LOUDSPEAKER ARRAY AND RELATED METHODS

This application claims the benefit of U.S. Provisional Patent Application No. 62/826,134, filed Mar. 29, 2019, the disclosure of which is incorporated herein by reference.

TECHNICAL FIELD

This document relates generally to high fidelity sound reproduction arts, and more specifically to a high fidelity sound reproduction system and audio loudspeaker array designed to improve the fidelity, or exactness, of the reproduced sound so that the listener perceives they are listening to a live performance.

BACKGROUND

High fidelity sound reproduction or a high fidelity experience is particularly desirable for audiophiles listening to a recording. High fidelity sound reproduction is also desirable for live sound reinforcement so that the overall effect of being at a performance is not diminished. In the case of listening to a recording by a few individuals, a high sound pressure level (SPL), or clarity, and associated power handling are not as critical as in live sound reinforcement applications where sound may need to be projected a great distance to many diversely positioned listeners. Further, in the case of a single person or a few individuals listening to a recording, it can be acceptable to have a "sweet spot" in a listening space wherein imaging of the sound is particularly vivid. In the case of many listeners, however, off axis imaging increases in importance, and in all cases, size and cost of the audio speakers are important considerations.

A key element of audio loudspeakers is the transducer, commonly called a driver, which is a device whose movement causes changes in sound pressure that reproduces the desired music or sound. Typical transducers used in high fidelity loudspeakers are illustrated in Table 1.

TABLE 1

| Transducer Type | Typical Frequency Range | Size and Cost |
|---|---|---|
| Piston Driver | Low (sub), mid, and high | Moderate size and low cost in mid frequency range. Subwoofer drivers can be large and expensive |
| Compression Driver | Mid and High (tweeter) | Typically, small and moderate cost |
| Planar/ Ribbon | High, down to mid | Large and expensive for both mid & high frequencies. Smaller and less expensive for high frequencies only. |
| Electrostatic | Mid and High | Most expensive transducer. Can be extended down to low frequency with considerable size and cost. |

As is known in the art, a typical driver has a voice coil and magnet, which act together when an electrical signal is applied to make a cone, or diaphragm, move back and forth causing sound pressure or sonic waves. The voice coil and magnet may be referred to collectively as a motor assembly. Each of these noted components is typically supported by a basket. The driver has two faces. A front or radiating face is open to the listening space and serves the purpose of radiating sound waves to a listener's ear. This configuration is referred to throughout the specification as forward facing. A back face is typically enclosed by an air space chamber in order to obtain a desired frequency response. The motor assembly is located on the backside of the driver. The common phrase used to describe the function of the air space chamber is that it loads the driver. In other words, the air space chamber is a loading chamber. In an alternative configuration, the driver may be supported such that the back face opens to the listening space radiating sound waves to the listener's ear. This configuration is referred to throughout the specification as rearward facing.

The loading chamber can be either sealed or ported, horn/scoop loaded, or loaded in a transmission line. When sealed, the back face does not directly contribute to the sound waves heard by the listener. When ported, air mass in the port or mass in a drone cone resonates with the driver at a specific frequency. When loaded in a transmission line or horn, low frequency sound waves are typically allowed to escape the loading chamber into the listening space through an opening in the loading chamber, often at a lower frequency than the sound waves transmitted to the listener directly from the front of the source. Since ports produce sound waves at lower frequencies and with unique coloration, i.e., addition of tones or alteration of original tones, ports are considered to be a separate sound source. Together, the driver and its loading chamber are called a loudspeaker.

Conventional audio loudspeaker designs attempt to achieve high fidelity sound reproduction through one of two approaches: (1) utilization of a combination of more than one transducer type or size where each transducer serves a distinct range of frequencies; or (2) utilization of a specialized transducer that is capable of serving an entire range of listening frequencies.

The most common high fidelity audio loudspeaker approach, approach (1), utilizes a combination of more than one transducer type or size. For example, a large piston driver will serve the lowest frequencies (subwoofer) (e.g., typically plays no higher than 80 Hz, but can play up to 250 Hz in certain designs), a smaller piston driver will serve the midrange frequencies, and yet a smaller driver will serve the highest frequencies (tweeter). In some combinations, the tweeter will be a compression driver such as in pro-audio applications where high sound pressure levels (SPL) at low cost is desirable. A typical sound reproduction system in the pro-audio market to cover the entire frequency range may utilize a loudspeaker having a subwoofer ported so that even lower frequencies can be achieved, and may port a midrange driver too to bridge the frequency gap between the subwoofer and the midrange. In such a loudspeaker, the listener has sound coming from five different sound sources over the frequency range from lowest to highest, including: (1) a subwoofer port; (2) a subwoofer; (3) a midrange port; (4) a midrange; and (5) a tweeter.

In a high fidelity sound reproduction system where less emphasis is placed on obtaining high SPL at low cost, and more emphasis is placed on sound quality, one or both ports in the combination described above may be eliminated. Without the subwoofer and midrange ports, the listener has sound coming from only three different sound sources over the frequency range from lowest to highest, including: (1) a subwoofer (2) a midrange; and (3) a tweeter.

Regardless of approach, it is a very difficult task to achieve fidelity high enough across so many different sound sources to recreate an image of a sound stage. Each sound source serves its purpose well in its assigned frequency range, but there is sonic confusion injected by different sound source types over the entire listening range, wherein sonic confusion is a lack of fidelity. Considering that music "notes" are comprised of multiple frequencies including a fundamental frequency and harmonic frequencies, it is often the case that a single musical note could be reproduced over two or three different sound sources in a sound reproduction system with multiple sound sources as described above.

Despite considerable discussion in the literature on how to make SPL nearly constant over a listening range when multiple types of sound sources are used, cost effective approaches to dealing with the sonic confusion created by the inherently different sound generation sources with high fidelity performance are scarce at best.

One variant to using piston or compression drivers for the high frequencies, generally described in the exemplary most common approach above, is the use of a ribbon driver, which claims to have superior sound creation. However, ribbon drivers are incapable of producing frequencies at the lowest end of the frequency range and thus must be paired with another sound source, for example, a piston subwoofer.

One example of the second approach, approach (2), to eliminating the different sound source types or sizes relies on the utilization of a large electrostatic transducer. While such a device can serve all frequency ranges, its high cost and large size limits its use. A smaller and less expensive version utilizes an electrostatic transducer for mid to high frequency ranges but incorporates a piston driver subwoofer to handle the low frequencies. Such a system is still very expensive relative to piston, compression, and even ribbon drivers due to the nature of electrostatic transducers and still requires use of different sound source types.

Yet another example of the second approach is a specialized piston driver. Due to the specifications that the single piston driver must satisfy, including serving all frequency ranges, it is very expensive, sometimes costing more than a complete system of different drive types.

Whether utilizing approach (1) with multiple transducer types or sizes, or approach (2) with a single transducer to achieve high fidelity sound reproduction, the high fidelity speaker industry has adopted a flat surface theory which predominantly teaches that a flat surface is the best means of achieving high fidelity. In fact, the touted advantage of the ribbon transducer and the electrostatic transducer is that they are flat, as opposed to the cone shape of a piston driver. The flat surface theory is that a flat transducer produces a coherent sonic waveform. This approach is so indoctrinated into speaker design that even multiple transducer speakers have the transducers positioned in a single plane so as to approximate a flat surface.

Even the pro-audio market has adopted the flat surface theory for improved sonic performance and has economically implemented it with arrays of transducers. As noted above, the need for low cost and high SPL is more important in the pro-audio market than in the high-fidelity market. Therefore, an array of standard transducers is a good method to achieve both relatively high output and low cost.

One such array is a column array wherein a number of transducers are stacked vertically and in the same plane. In other words, each of the transducers is supported at the same angle to a plane in the listening space. The spacing between transducers is minimized so that the effect of comb filtering is minimized; otherwise at high frequencies the output from one transducer in the array will cancel out the output from a second transducer in the array based on the distance from each transducer to a listening position. Column arrays are 1×N wherein 1 is the number of transducer columns and N is the number of transducer rows.

A second type of array is a line array which is often comprised of at least one midrange column(s) and a tweeter column. The number of transducers used in the midrange column may be different than the number in the tweeter column. Again, when used within a line array, the individual line arrays are 1×N. When two midrange columns are used in a line array, a typical configuration is mid-tweeter-mid.

Due to both the need to cover the listening space and the human ear's ability to better discern differences between a horizontal array and a vertical array, pro-audio arrays are predominantly vertical. Vertical array(s) can be sized and aimed to cover an entire listening space (e.g., all of an audience in a given venue). One modification to the flat, vertical line array is a J-array where a lower elevation of the J-array is formed into an arc to better cover the listening space or audience. Often the J-array is formed using modular units of arrays arranged in an arc instead of individual transducers being arranged in an arc. Again, the purpose of the arc shape of the lower elevation is to improve sound dispersion, which means to better cover the listening space or audience with a more consistent SPL. The arc formation does not, however, improve the sound quality for any listener.

Line arrays used in pro-audio applications offer some improved sonic performance relative to a single driver due to the averaging of distortion from many drivers. As a result, distortion from any one driver is masked to the degree that each driver has its own distortion signature and not a common distortion shared with all the other drivers. This improvement in sonic performance, however, is insufficient to meet the imaging requirement necessary for the listener to perceive the recording sounds like a live performance. For live sound imaging, the loudspeaker system should substantially reproduce in three dimensions the location of sound sources. A good live sound imaging system, for example, will sound like a lead singer is closer to the listener than the drummer who is located behind the lead singer.

When an array of radiating drivers is being discussed, it is important to understand whether the drivers are operating in common acoustic phase or in opposing acoustic phase. Acoustic phase is in reference to the polarity of the sound pressure wave radiating into a listening space where the sound is received by a listener and is a combination of both mechanical and electrical phase of the drivers. For the drivers to operating in common acoustic phase, the drivers must face the same way and be wired with the same polarity or the drives may face opposite one another and be wired with opposite polarity.

As described above, one limitation of conventional audio speaker designs is the utilization of differing driver types or sizes to address a full range of listening frequencies and the resultant crossover between the different driver types or sizes which reduces fidelity and hinders live sound imaging. Further, the conventional designs practice linear sound pressure generation with various techniques including ribbons, electrostatic and line arrays which are not optimal for imaging and, in particular, not suitable for off axis imaging which is a desirable component of live sound imaging. Accordingly, a need exists in the loudspeaker industry for a high fidelity audio speaker capable of imaging a sound stage and without the limitations of the prior art.

SUMMARY OF THE INVENTION

In accordance with the purposes and benefits described herein, an audio speaker is provided. The audio speaker may be broadly described as comprising a frame or manifold supporting a plurality of drivers electrically connected to operate in common acoustic phase. The plurality of drivers includes an inner group of drivers and an outer group of drivers at least partially surrounding the inner group of drivers, wherein the outer group of drivers includes at least two drivers with at least one the two drivers being a rearward facing driver.

In an additional possible embodiment, each of the plurality of drivers is the same size.

In another possible embodiment, the inner group of drivers includes at least one rearward facing driver. In another similar embodiment, each of the plurality of drivers is supported by the frame at a unique angle relative to a plane in the listening space.

In yet another possible embodiment, each of the plurality of drivers is supported by the frame at a unique angle relative to a plane in the listening space.

In still another possible embodiment, the inner group of drivers includes at least one rearward facing driver and the outer group of drivers includes at least one rearward facing driver. In another similar embodiment, each of the plurality of drivers is supported by the frame at a unique angle relative to a plane in the listening space.

In one additional possible embodiment, the frame is flat.

In still another possible embodiment, the frame is spherical. In another similar embodiment, each of the plurality of drivers is supported by the frame at a unique angle relative to a plane in the listening space.

In yet still another possible embodiment, the outer group of drivers is arranged in a circular formation around the inner group of drivers.

In another possible embodiment, the plurality of drivers are arranged in an M×N array, wherein N represents the number of drivers in the inner group of drivers and is at least 1 and M represents the number of drivers in the outer group of drivers and is at least 5. In a similar embodiment, the frame is spherical.

In still another possible embodiment, the inner group of drivers includes a single driver.

In yet another possible embodiment, the plurality of drivers further includes an intermediate group of drivers at least partially surrounding the inner group of drivers. In still another possible embodiment, each of the drivers in the intermediate group of drivers is rearward facing.

In one other possible embodiment, the frame is enclosed by an air space chamber.

In still another possible embodiment, the audio speaker further includes an enclosure supporting the frame.

In still yet another possible embodiment, the audio speaker further includes a loading driver positioned within the airspace chamber.

In one other possible embodiment, each of the drivers in the outer group of drivers is supported by the frame at a greater distance from a plane in the listening space than each of the drivers in the inner group of drivers.

In another possible embodiment, each of the drivers in the outer group of drivers is rearward facing.

In the following description, there are shown and described several embodiments of audio speakers. As it should be realized, the audio speakers are capable of other, different embodiments and their several details are capable of modification in various, obvious aspects all without departing from the audio speakers as set forth and described in the following claims. Accordingly, the drawings and descriptions should be regarded as illustrative in nature and not as restrictive.

BRIEF DESCRIPTION OF THE DRAWING FIGURES

The accompanying drawing figures incorporated herein and forming a part of the specification, illustrate several aspects of the audio speakers and together with the description serve to explain certain principles thereof. In the drawing figures.

Figure 15:
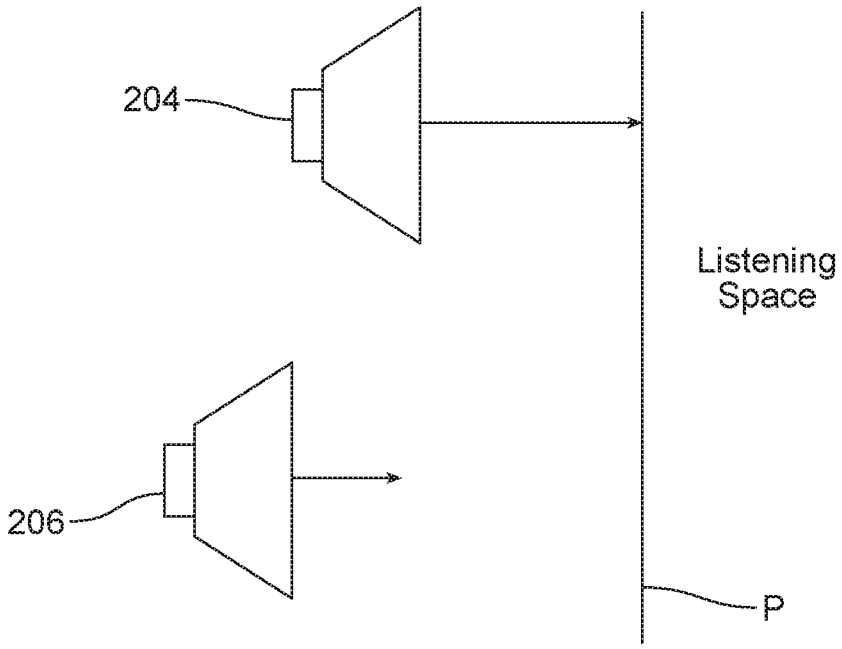
Figure 16:
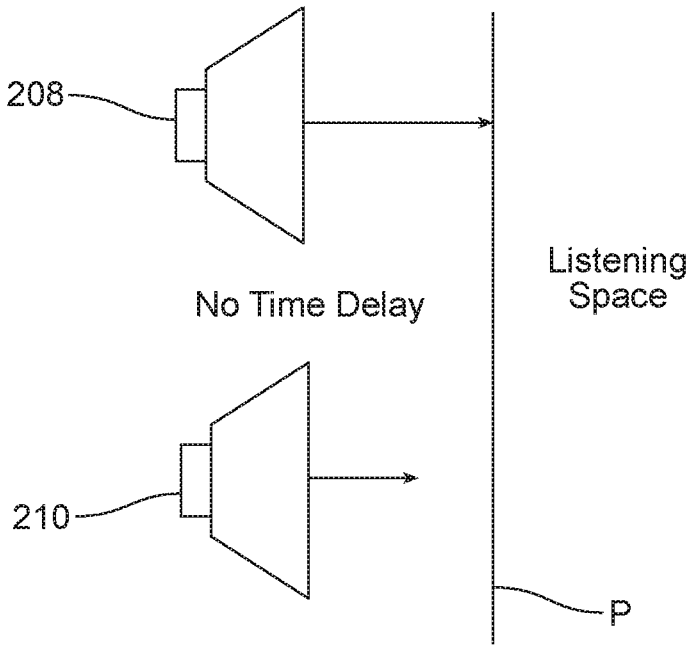

FIG. 15 is a schematic diagram showing sound waves radiating from inner and outer drivers positioned at different distances from a listening space such that the sound waves arrive at the listening space at different times dependent upon a distance of the inner and outer drivers from the listening space and possibly an additional time delay applied to the outer driver; and FIG. 16 is a schematic diagram showing sound waves radiating from inner and outer drivers positioned an equal distance from a listening space such that the sound waves arrive at the listening space at different times dependent upon an additional time delay applied to the outer driver.

Reference will now be made in detail to the present embodiments of the audio speakers, examples of which are illustrated in the accompanying drawing figures, wherein like numerals are used to represent like elements.

DETAILED DESCRIPTION

Figure 1:
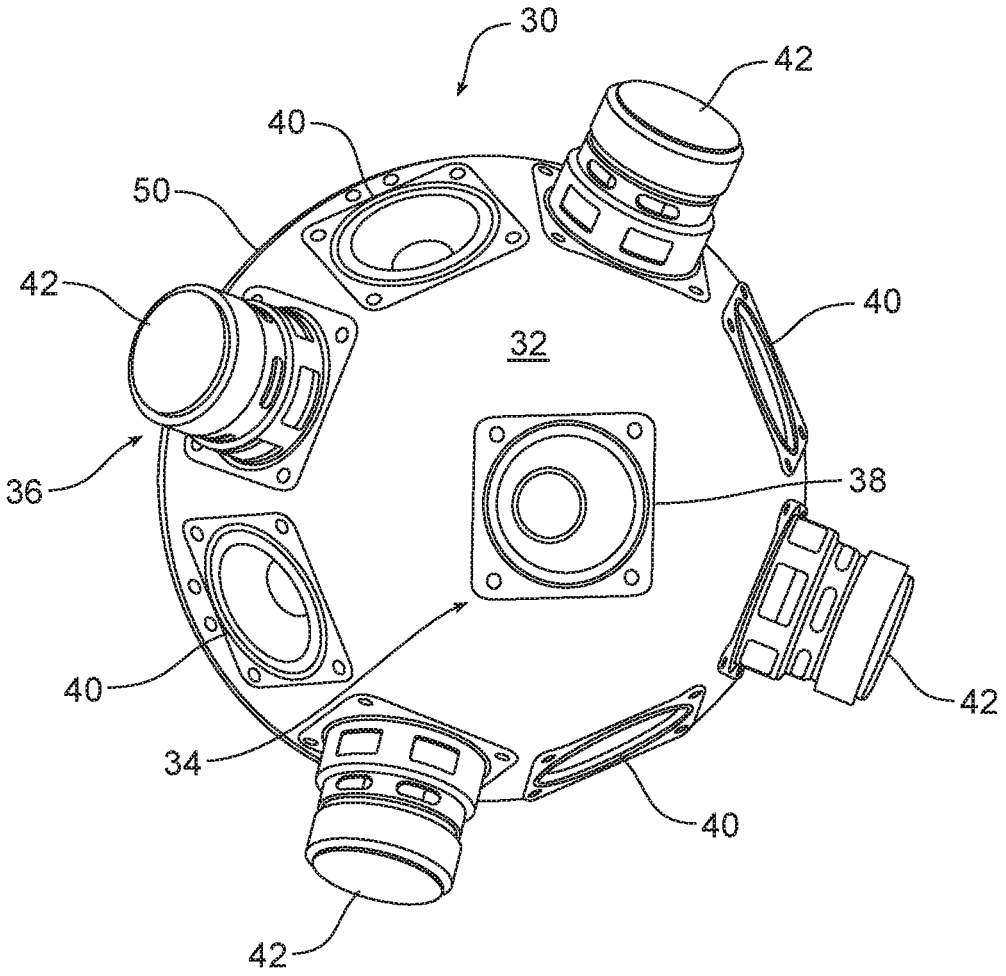
FIG. 1 is a perspective view of an audio speaker array showing a plurality of drivers, including an inner group of driver(s) surrounded by an outer group of drivers, mounted to a generally hemispherical frame with the drivers in the outer group of drivers mounted in an alternating forward and rearward facing manner.

Reference is now made to FIG. 1 which illustrates one embodiment of an audio speaker array 30. As shown, the described audio speaker array, or speaker array, 30 includes a plurality of drivers supported by, or mounted or attached to, a frame or manifold 32. The plurality of drivers includes an inner group of drivers 34 and an outer group of drivers 36. In this embodiment, and each of the embodiments described herein, multiple common drivers are utilized which are electrically connected to operate in common acoustic phase. In other words, each of the drivers in the inner and outer groups of drivers are the same type and size (e.g., all purchased from the same manufacturer so they will have very similar characteristics) which necessarily minimizes the number of different types of sound sources and improves fidelity. Of course, additional embodiments could utilize different drivers but at the expense of the improved fidelity. Moreover, in the embodiments described herein, each of the drivers is a piston driver capable of playing a full frequency range which also lowers cost.

Depending on the diameter of the full-range drivers implemented in the speaker arrays disclosed herein, a speaker array will have an ability to play down to a certain frequency. The larger the diameter of the driver, the lower frequency it can play. The tradeoff with larger drivers, however, is their difficulty in playing higher frequencies. In the embodiments described herein, the plurality of drivers in the speaker arrays are selected to be within a 2" diameter to 4" diameter range. For the most demanding high fidelity applications where the speaker array is utilizing drivers in the 2" to 4" diameter range playing all the way to the top of the human listening range of 20,000 Hz, then it is typical that the speaker array could play down to 100 Hz. If frequencies lower than 100 Hz are required, then a subwoofer may be added to a system to play from 100 Hz down to whatever frequency the listener desired such as 20 Hz.

As shown in FIG. 1, the inner group of drivers 34 in this embodiment includes a single driver 38. The single driver 38 is mounted to the frame 32 in a forward facing and generally central manner in a manner known in the art. The outer group of drivers 36 are similarly mounted to the frame 32 in a ring or circular configuration surrounding the inner group of drivers 34. In this embodiment, there are eight drivers in the outer group of drivers 36 mounted to the frame with four forward facing drivers 40 positioned in an alternating manner with four rearward facing drivers 42. In other words, the drivers alternate between forward and rearward facing along the ring or circle as shown.

Figure 2:
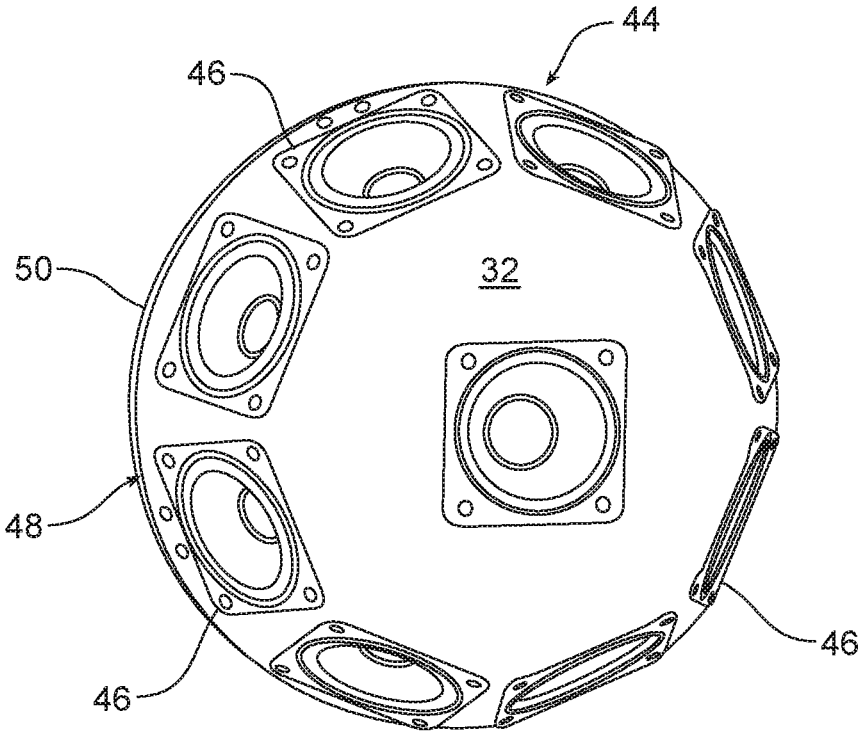
FIG. 2 is a perspective view of an audio speaker array showing a plurality of drivers, including an inner group of driver(s) surrounded by an outer group of drivers, mounted to a generally hemispherical frame with each of the drivers in the inner and outer groups of drivers mounted in a forward facing manner.

A similar embodiment of a speaker array 44 is shown in FIG. 2. In this embodiment, the speaker array 44 is the same as the speaker array 30 except each driver 46 in an outer group of drivers 48 is mounted to the frame 32 in the ring configuration in a forward facing manner as shown.

As is known in the art, a typical driver has a voice coil and magnet, which act together when an electrical signal is applied to make a cone, or diaphragm, move back and forth causing sound pressure waves. Each of these components is typically supported by a driver frame, commonly called a basket. Each driver has two faces. A front or radiating face is typically open to the listening space and serves the purpose of radiating sound waves to the listener's ear. A back face and frame are typically enclosed by an air space chamber in order to obtain a desired frequency response. The common phrase used to describe the function of the air space chamber is that it loads the driver. In other words, the air space chamber is a loading chamber. Although not required, each of the speaker array embodiments described herein includes a loading chamber 50 which may take any size or shape, and may or may not be loaded with an acoustical transducer such as an additional driver.

In addition to utilizing inner and outer groups of drivers, extensive testing reveals that improved fidelity occurs when center points of the drivers in a speaker array form a three dimensional space and each of the drivers points in a different direction, and hence at a different angle relative to a hypothetical plane in the listening space. As shown in FIGS. 1 and 2, mounting the inner and outer groups of drivers to a hemispherical, or near hemispherical, frame 32 necessarily results in the center points of the drivers forming a three dimensional space and each of the drivers pointing in a different direction and at a different angle relative a plane in the listening space.

In these arrangements, the sonic waves from the outer group of drivers reach the listener's ears at a different point in time than the sonic waves from the inner group of drivers due to the inner group of drivers being physically closer to the listening space. An additional beneficial result of these arrangements is that the drivers in the inner and outer groups of drivers are in close proximity to one another. These phenomena in combination provide for improved fidelity both on axis and off axis.

As shown in a later described embodiment, the speaker arrays may be formed with inner, outer and one or more intermediate groups of drivers. For example, in the embodiments described in FIGS. 1 and 2, the speaker arrays could be formed with two or more rings of drivers mounted around the inner driver with each ring supported at a different distance from the listening space. In addition, the inner group of drivers could include more than one driver. Illustrative variations around FIGS. 1 and 2 are listed below in Table 2.

TABLE 2

| Inner Group of Drivers | Intermediate Group of Drivers | Outer Group of Drivers | |
|---|---|---|---|
| 1 driver | N/A | 8 drivers | Illustrated in FIGS. 1 and 2 |
| 4 drivers | N/A | 12 drivers | Variant from FIGS. 1 and 2 |
| 1 driver | 8 drivers | 24 drivers | Variant from FIGS. 1 and 2 |

Figure 3:
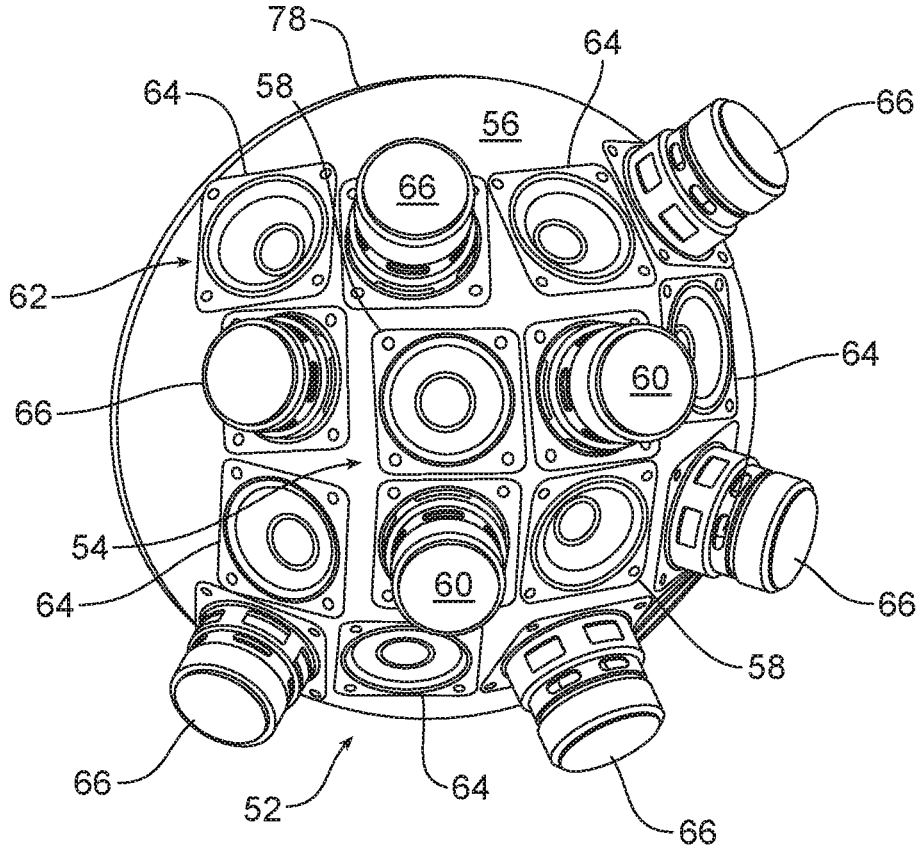
FIG. 3 is a perspective view of an audio speaker array showing a plurality of drivers, including an inner group of driver(s) surrounded by an outer group of drivers, which together form a 4×4 array, mounted to a generally hemispherical frame with the drivers in the inner and outer groups of drivers mounted in an alternating forward and rearward facing manner.

Turning now to FIG. 3, an alternative embodiment of an audio speaker array 52 similarly includes a plurality of common drivers electrically connected to operate in common acoustic phase. As shown, an inner group of drivers 54 in this embodiment includes four drivers mounted to a frame 56 in a generally central manner. More specifically, the four drivers are arranged in a 2×2 array including two forward facing drivers 58 and two rearward facing drivers 60 as shown. The outer group of drivers 62 is similarly mounted to the frame 56 and together with the inner group of drivers 54 form a 4×4 array. Other embodiments could use more or fewer drivers in one or both of the inner and/or outer groups in an M×N array. In this embodiment, there are twelve drivers in the outer group of drivers 62 mounted to the frame 56 with six forward facing drivers 64 positioned in an alternating manner with six rearward facing drivers 66. In other words, the drivers alternate between forward facing and rearward facing along the perimeter of the 4×4 array as shown.

Figure 4:
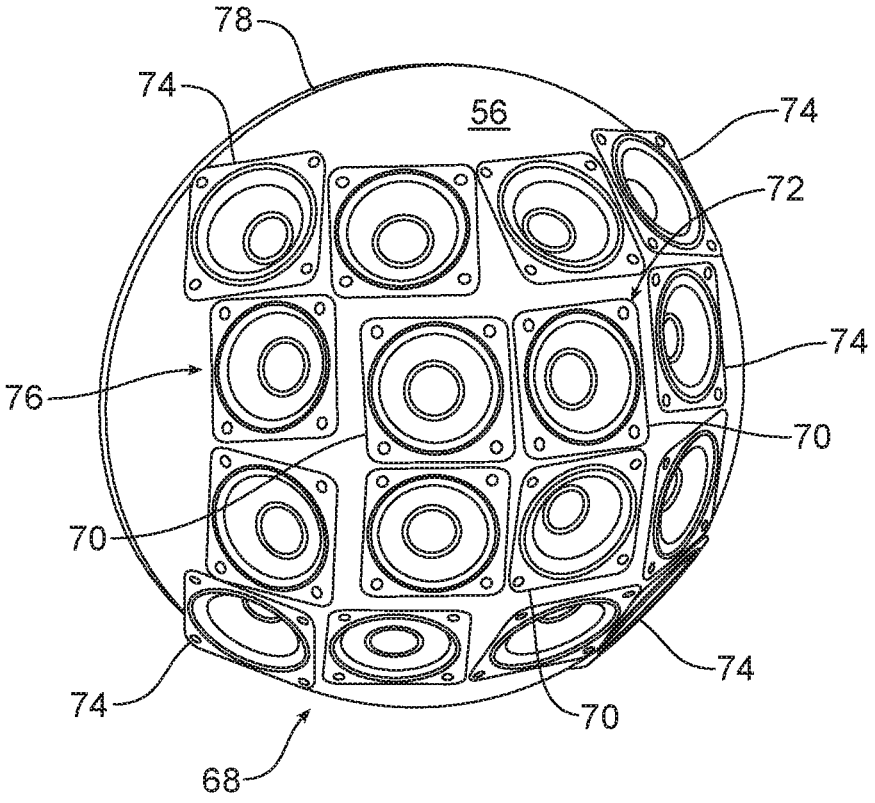
FIG. 4 is a perspective view of an audio speaker array showing a plurality of drivers, including an inner group of driver(s) surrounded by an outer group of drivers, which together form a 4×4 array, mounted to a generally hemispherical frame with each of the drivers in the inner and outer groups of drivers mounted in a forward facing manner.

A similar embodiment of a speaker array 68 is shown in FIG. 4. In this embodiment, the speaker array 68 is the same as the speaker array 52 except each driver 70 in an inner group of drivers 72 and each driver 74 in an outer group of drivers 76 is mounted to the frame 56 in the 4×4 array in a forward facing manner as shown.

Similar to the embodiments shown in FIGS. 1 and 2, each of the drivers in the M×N array embodiments shown in FIGS. 3 and 4 are mounted to a hemispherical, or near hemispherical, frame 56 such that each driver's face is tangential to the frame 56 at its location. Mounting the inner and outer groups of drivers to a hemispherical, or near hemispherical, frame 56 necessarily results in the center points of the drivers forming a three dimensional space and each of the drivers pointing in a different direction and at a different angle relative a plane in the listening space. An advantage of these embodiments over the embodiments shown in FIGS. 1 and 2 is that a greater number of drivers, and hence a higher SPL, can be achieved with a given hemispherical frame size. In addition, each of the M×N array embodiments shown in FIGS. 3 and 4 include a loading chamber 78. The loading chamber 78 may take any size or shape and may or may not be loaded with an acoustical transducer such as an additional driver.

In each of the embodiments shown in FIGS. 1-4, the sonic waves from the outer group of drivers reach the listener's ears at a different point in time than the sonic waves from the inner group of drivers do due to the inner group of drivers being physically closer to the listening space. An additional beneficial result of these embodiments is that the drivers in the inner and outer groups of drivers are in close proximity to one another. These phenomena in combination provide for improved fidelity both on and off axis.

As shown in a later described embodiment, the speaker arrays may be formed with inner, outer and one or more intermediate groups of drivers. For example, in the embodiments described in FIGS. 3 and 4, the speaker arrays could be formed with one or more intermediate groups of drivers. In such embodiments, sonic waves from the one or more intermediate groups of drivers would similarly reach the listener's ears at different points in time than the sonic waves from the inner and outer groups of drivers. In addition, the inner group of drivers could include more or fewer than four drivers. Illustrative variations around FIGS. 3 and 4 are listed below in Table 3.

TABLE 3

| Inner Group of Drivers | First Level Outer Group of Drivers | Second Level Outer Group of Drivers | |
|---|---|---|---|
| 4 drivers | 12 drivers | N/A | Illustrated in FIGS. 3 and 4 |
| 4 drivers | 12 driver | 18 drivers | Variant from FIGS. 3 and 4 |
| 2 drivers | 6 drivers | N/A | Variant from FIGS. 3 and 4 |

Figure 5:
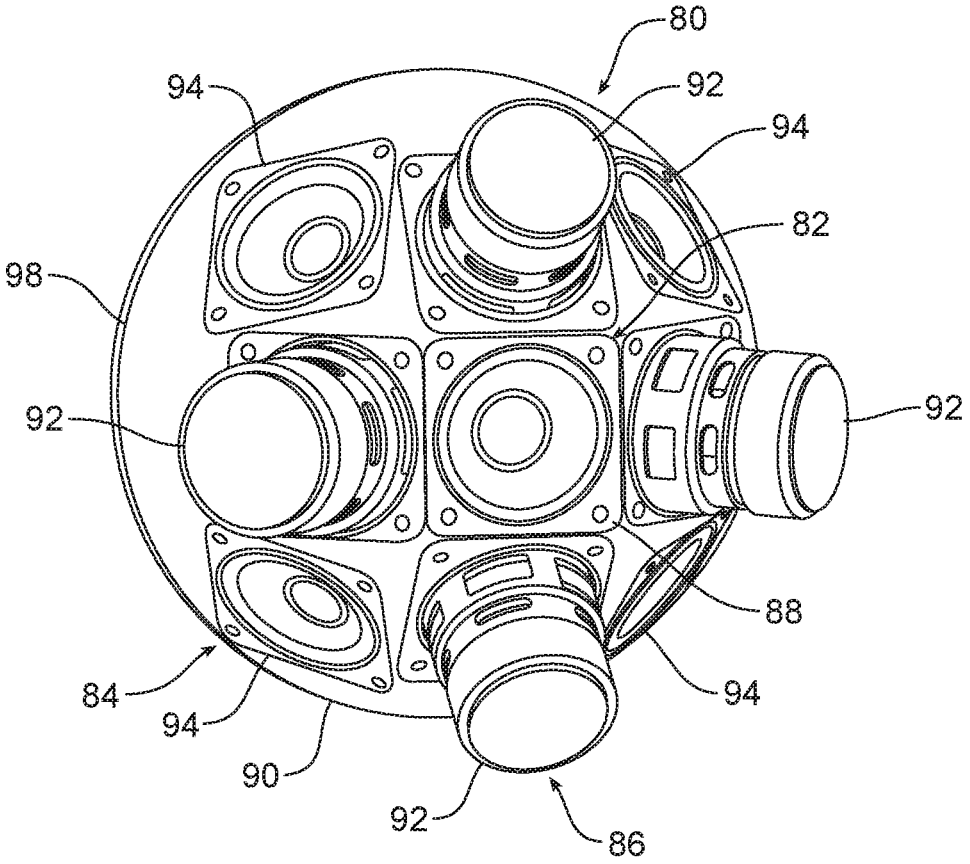
FIG. 5 is a perspective view of an audio speaker array showing a plurality of drivers, including an inner group of driver(s) surrounded by intermediate and outer groups of drivers mounted to a generally hemispherical frame with the drivers in the intermediate group of drivers mounted in a rearward facing manner and the drivers in the outer group of drivers mounted in a forward facing manner.

One specific alternative embodiment of an audio speaker array 80 is formed with an inner, an outer, and an intermediate group of drivers 82, 84, and 86 is shown in FIG. 5. Similar to the embodiments shown in FIGS. 3 and 4, the audio speaker array 80 includes a plurality of common drivers electrically connected to operate in common acoustic phase. As shown, the inner group of drivers 82 includes one driver 88 mounted to a frame 90 in a generally central and forward facing manner in a manner known in the art. The intermediate group of drivers 82 includes four rearward facing drivers 92 and the outer group of drivers 84 includes four forward facing drivers 94 that are all mounted to the frame 90. More specifically, the inner and intermediate groups of drivers 80 and 82 form a cross or a plus symbol as shown.

The result of the arrangement of forward and rearward facing drivers within the intermediate and outer groups of drivers 86 and 84 is that the drivers alternate between forward facing and rearward facing along essentially a perimeter of the speaker array 80 as shown. It is worth noting, however, that the intermediate group of drivers 86 is unique from the outer group of drivers 84 based on a distance from a center point of the frame 90 to the center point of any one driver in the intermediate and outer groups of drivers.

Similar to the embodiments shown in FIGS. 1 and 2, each of the plurality of drivers shown in FIG. 5 is mounted to a hemispherical, or near hemispherical, frame 96 which includes a loading chamber 98. The loading chamber 98 may take any size or shape and may or may not be loaded with an acoustical transducer such as an additional driver. Mounting the inner, intermediate, and outer groups of drivers to a hemispherical, or near hemispherical, frame 96 necessarily results in the center points of the drivers forming a three dimensional space and each of the drivers pointing in a different direction and at a different angle relative a plane in the listening space.

In this embodiment, the sonic waves from the intermediate and outer groups of drivers 86 and 84 reach the listener's ears at different points in time than the sonic waves from the inner group of drivers 82 do due to the inner group of drivers being physically closer to the listening space. An additional beneficial result of this embodiment is that the drivers in the inner, outer, and intermediate groups of drivers 82, 84 and 86 are in close proximity to one another. Again, these phenomena in combination provide for improved fidelity both on and off axis.

As shown in the embodiments illustrated in FIGS. 1-5, a plurality of drivers can be mounted to a frame in an alternating or varying forward/rearward manner in order to attain an optimal angle for radiating sonic waves into the listening space. Such arrangements, however, are contrary to conventional design philosophy which teaches that a front of mid and high frequency piston drivers must face the listening space or be forward facing as described above. This conventional thought is due to a valid understanding that sound waves become increasingly directional with increasing frequency and therefore positioning the motor assembly of the driver on a front side of the speaker, i.e., the side that radiates sound waves into the listening space, would redirect the sound waves from direct radiation into the listening space. At lower frequencies, however, sound wave travel becomes omnidirectional such that a motor assembly of one driver blocking a direct path of sound from its cone to the listener is relatively insignificant and thus less of a concern.

Figure 6:
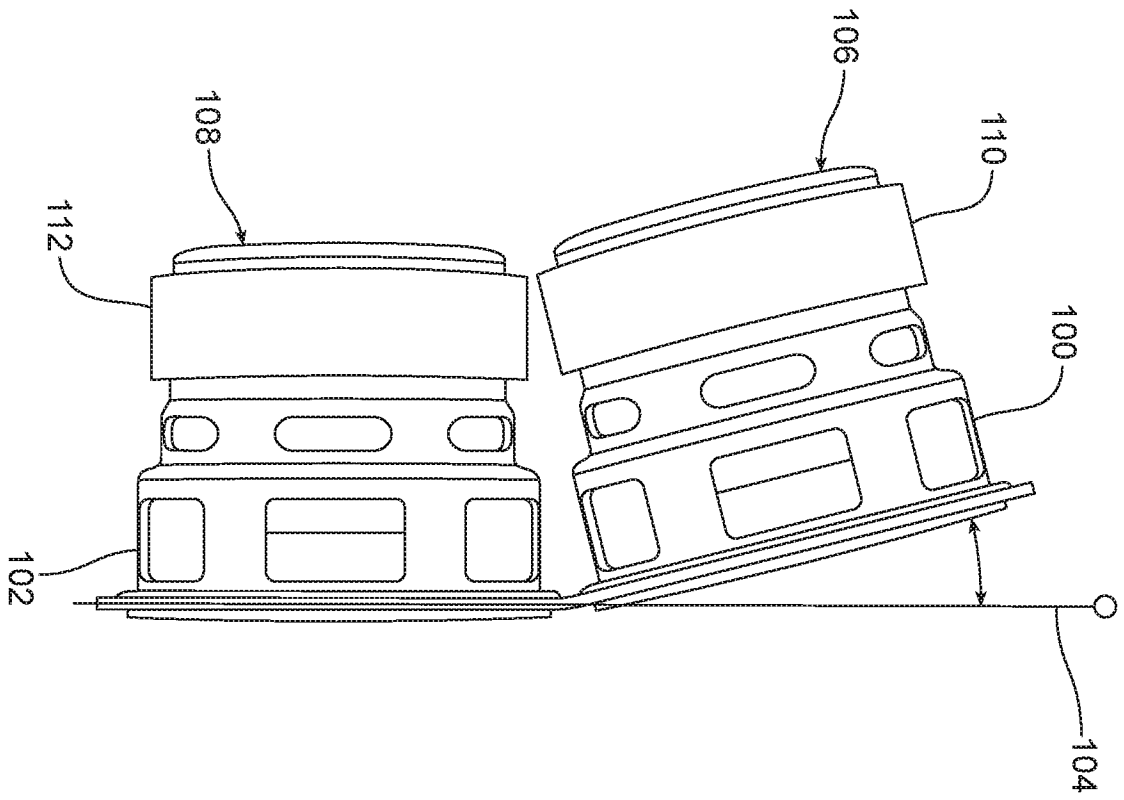
FIG. 6 is a side plan view of two drivers in an audio speaker array mounted in a forward facing manner to a frame.
Figure 7:
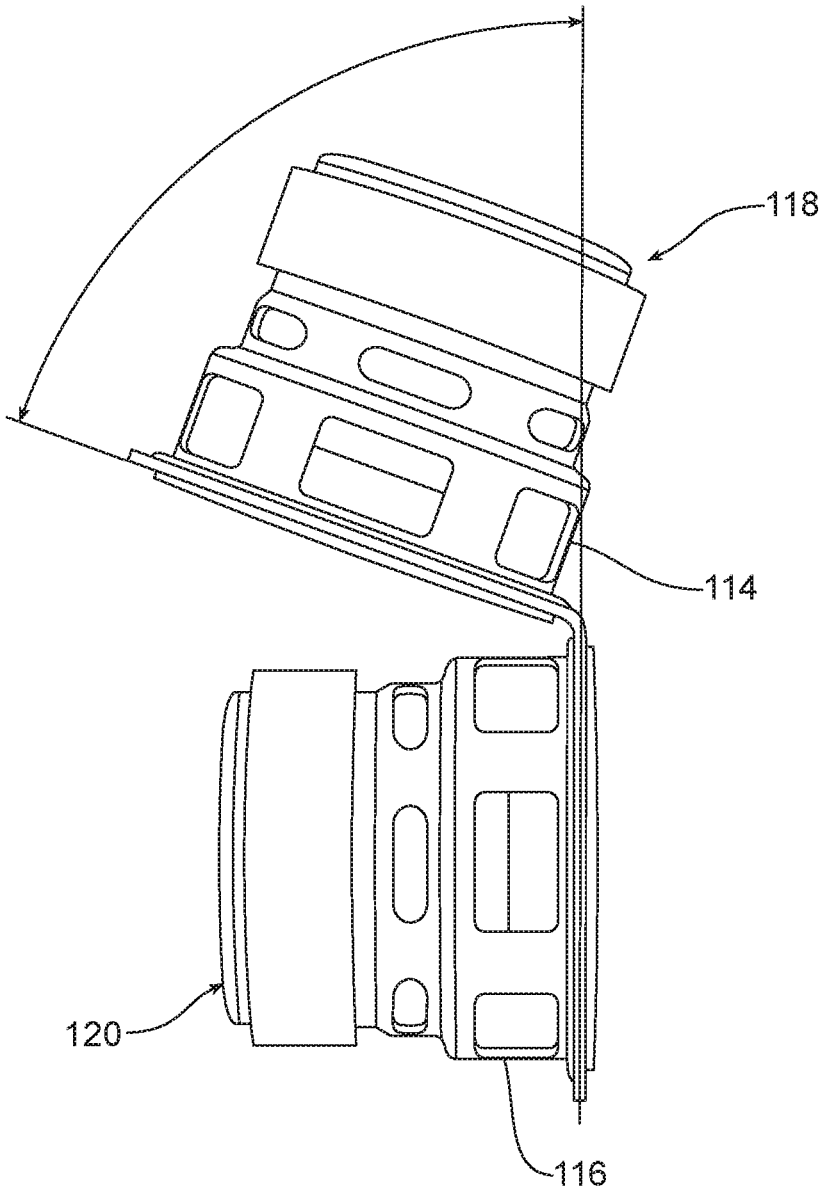
FIG. 7 is a side plan view of two drivers in an audio speaker array with one driver mounted in a forward facing manner to a frame and a second driver mounted in a rearward facing manner to the frame.

As illustrated in FIG. 6, piston driver motor assemblies of two drivers 100, 102 of close proximity mounted to a frame 104 in forward facing manner limit an angle difference between the two adjacent drivers. As the angle between the two close proximity drivers 100, 102 increases, their motor assemblies 106, 108 will mechanically interfere at some point based on the size of their magnets 110, 112. This limiting factor prevents an optimum angle for sonics from being reached. In order to overcome this limitation, certain drivers within the inner, intermediate, and/or outer groups of drivers described herein may be mounted to a frame in a rearward facing manner as illustrated in FIG. 7. This arrangement allows for a significantly greater angle between two close proximity or adjacent drivers 114, 116 to be achieved without the noted mechanical interference between their respective motor assemblies 118, 120.

Without discarding conventional thought regarding mid and high frequency being increasingly directional, the inventor has determined that the benefit from a freedom to create greater angles between drivers more than offsets the limited alteration of the sonic wave form due to the position of the motor assembly. As illustrated in FIGS. 6 and 7, the projection angles obtained with a portion of the plurality of drivers mounted to the frame in a rearward facing manner are greater than angles obtained when the drivers were all mounted in a forward facing manner. For the piston drivers chosen to make this illustration in FIG. 6, for example, a maximum projection angle of 14 degrees is possible. As shown in FIG. 7, however, mounting one driver in a forward facing manner and a second driver in a rearward facing manner increases the maximum projection angle up to 70 degrees.

Figure 8:
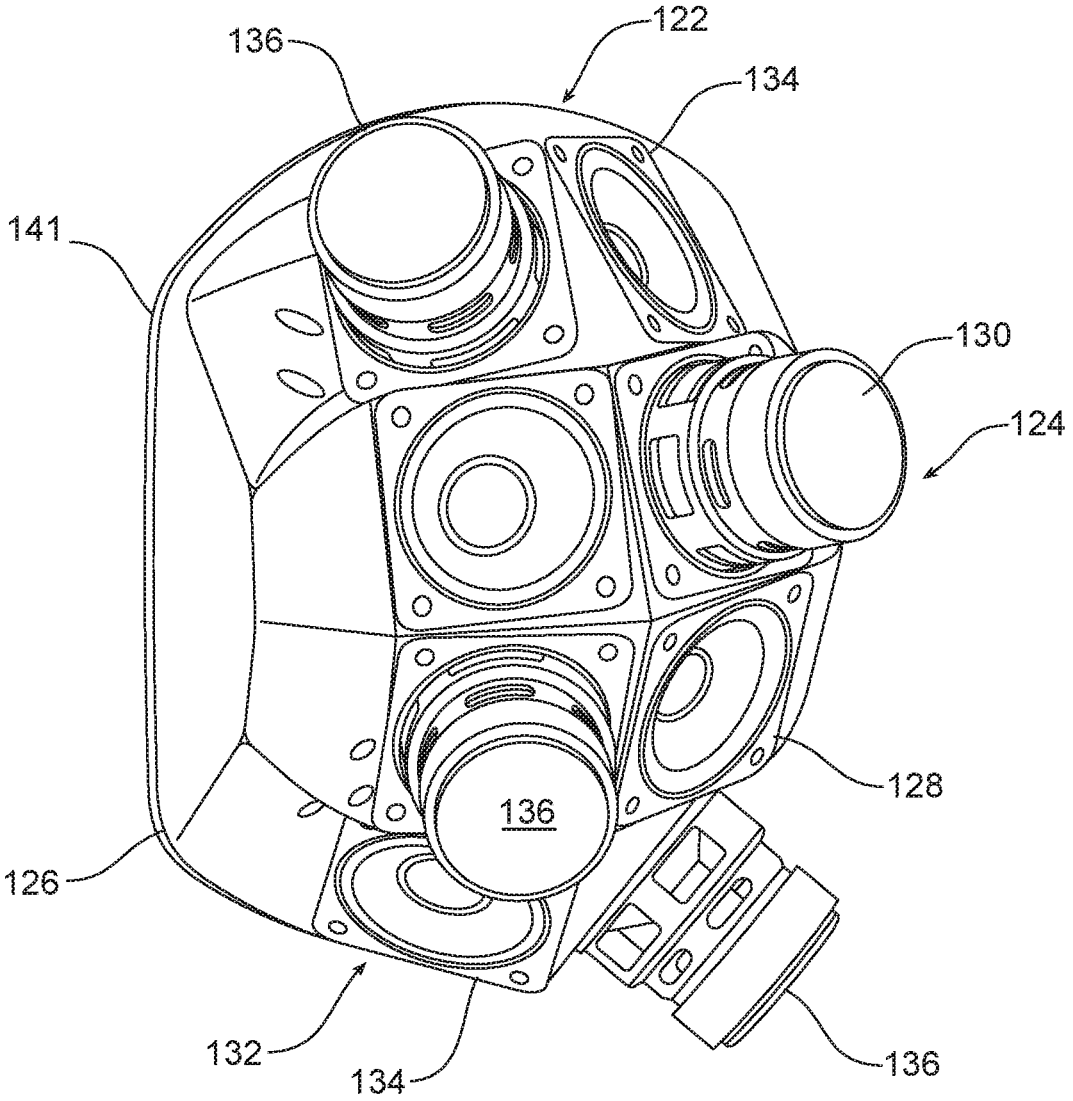
FIG. 8 is a perspective view of an audio speaker array showing a plurality of drivers, including an inner group of drivers partially surrounded by an outer group of drivers, which together form a 2×4 array, mounted to a generally compound angle frame with the drivers in the inner and outer groups of drivers mounted in an alternating forward and rearward facing manner.

Turning now to FIG. 8, an alternate embodiment of an audio speaker array 122 similarly includes a plurality of common drivers electrically connected to operate in common acoustic phase. As shown, an inner group of drivers 124 in this embodiment includes two drivers mounted to a frame 126 in a manner known in the art. More specifically, the two drivers are arranged in a 1×2 array including one forward and one rearward facing driver 128, 130 as shown. An outer group of drivers 132 is similarly mounted to the frame 126 and together with the inner group of drivers 124 form a 2×4 array. Other embodiments could use more or fewer drivers in one or both of the inner and/or outer groups in a combined M×N array. In this embodiment, there are six drivers in the outer group of drivers 132 mounted to the frame 126 with three forward facing drivers 134 positioned in an alternating manner with three rearward facing drivers 136. In other words, the drivers alternate between forward facing and rearward facing along the 2×4 array as shown.

Figure 9:
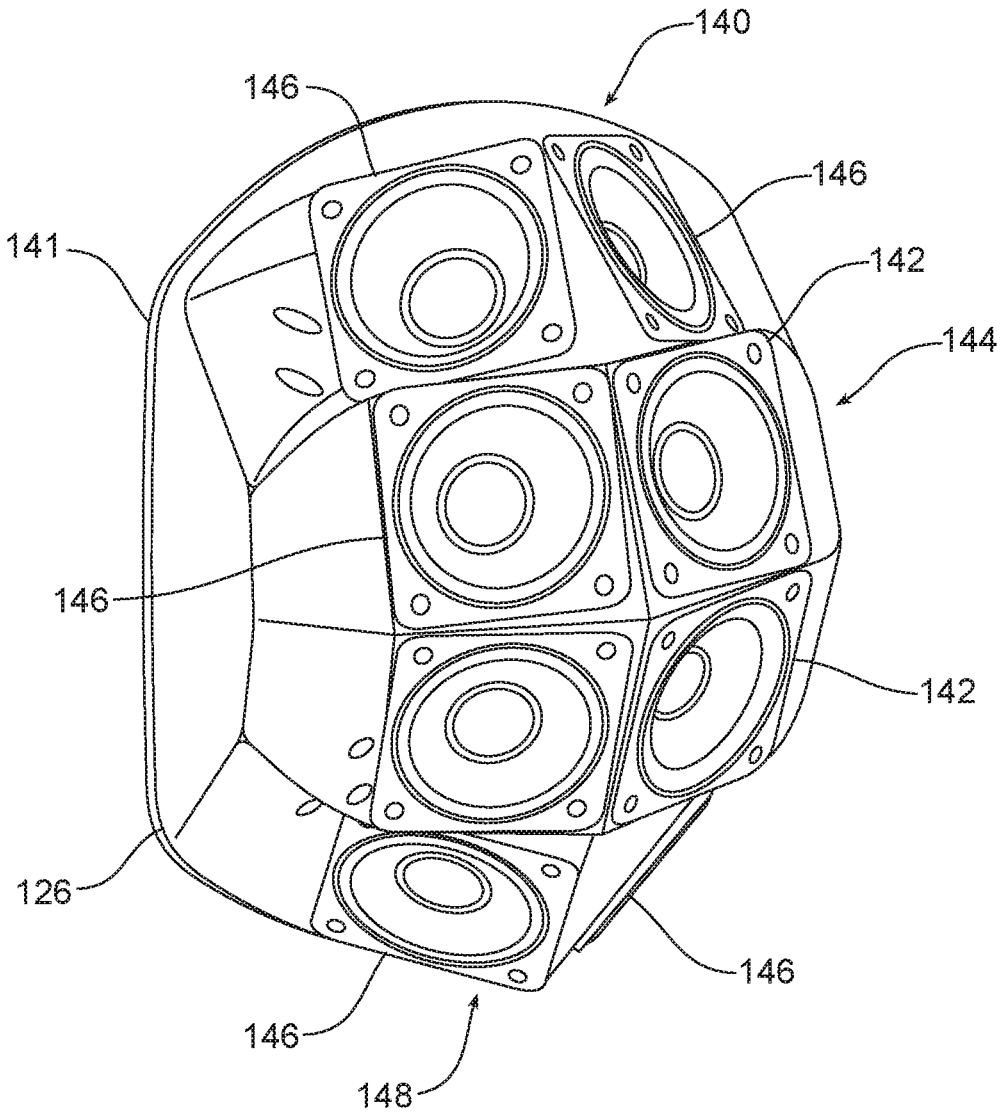
FIG. 9 is a perspective view of an audio speaker array showing a plurality of drivers, including an inner group of driver(s) partially surrounded by an outer group of drivers, which together form a 2×4 array, mounted to a generally compound angle frame with each of the drivers in the inner and outer groups of drivers mounted in a forward facing manner.

A similar embodiment of a speaker array 140 is shown in FIG. 9. In this embodiment, the speaker array 140 is the same as the speaker array 122 except each driver 142 in an inner group of drivers 144 and each driver 146 in an outer group of drivers 148 is mounted to the frame 126 in the 2×4 array in a forward facing manner as shown.

Quite different from the embodiments disclosed thus far, each of the 2×4 array embodiments shown in FIGS. 8 and 9 are mounted to a compound angle manifold or frame 126 and include a loading chamber 140. The loading chamber 140 may take any size or shape and may or may not be loaded with an acoustical transducer such as an additional driver. Mounting the inner and outer groups of drivers to a compound angle frame 126 necessarily results in the center points of the drivers forming a three-dimensional space and each of the drivers pointing in a different direction and at a different angle relative a plane in the listening space. Nevertheless, testing suggests that sonics in these compound angle manifold embodiments are not as improved as in the embodiments shown in FIGS. 1-5. That said, the frame 126 is smaller and, therefore, may be less expensive to produce. Further reductions in cost are created through use of fewer drivers overall. As shown, the outer groups of drivers 132 and 148 only partially surround the inner groups of drivers 124 and 144, respectively, thus reducing the overall numbers of drivers.

It should also be noted that in each of these embodiments only a portion of the sonic waves from the outer groups of drivers reach the listener's ears at a different point in time than the sonic waves from the inner group of drivers do due to two drivers of the outer group of drivers and the inner group of drivers being equidistant from the listening space. This issue may be addressed in this and other embodiments using timing control methods to delay the arrival of sound waves as will be described in greater detail below. Again, an additional beneficial result of these embodiments is that the drivers in the inner and outer groups of drivers are in close proximity to one another. These phenomena in combination provide for improved fidelity both on and off axis.

As with the other embodiments, there are many variations for the compound angle frame embodiments. In one such embodiment, an audio speaker array may include a plurality of common drivers electrically connected to operate in common acoustic phase that includes only four drivers. For example, the four central drivers shown in FIG. 8. In such an embodiment, the four drivers are arranged in a 2×2 array wherein an inner group of drivers includes two drivers and an outer group of drivers, partially surrounding the inner group of drivers, includes two drivers. Using 2-inch drivers would provide for a front face of the speaker array being about 4 inches square. Of course, the same benefits and drawbacks described above for embodiments using the compound angle frame would apply to these embodiments as well. Even more, each of the inner and outer groups of drivers could include one forward facing and one rearward facing driver as described in greater detail above.

In still other embodiments illustrated in FIGS. 10, 11, 12, and 13, the frame or manifold in each is generally described as planar or flat which provides for potentially the lowest cost. In addition to lower cost, utilizing a flat frame may be more conducive to some markets, such as the pro-audio market, where both low cost and a flat front speaker enclosure are important considerations. One drawback in such embodiments, however, is that flat frames do not offer unique angles for each driver thus lowering the fidelity threshold. While the desired fidelity threshold in the pro-audio market is not as high as the fidelity threshold for audiophiles, the fidelity threshold can be improved using other elements described herein.

Figure 10:
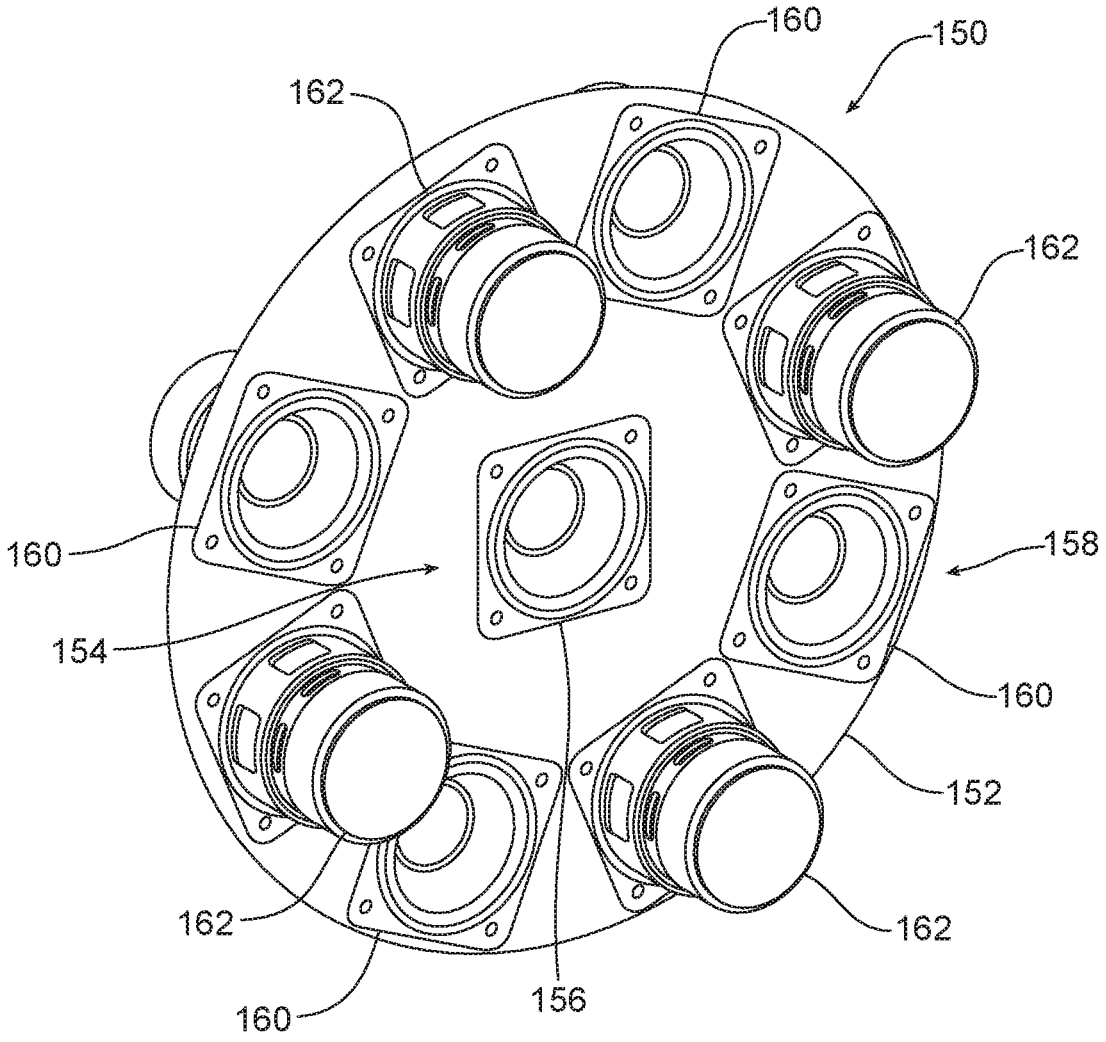
FIG. 10 is a perspective view of an audio speaker array showing a plurality of drivers, including an inner group of driver(s) surrounded by an outer group of drivers, mounted to a generally flat frame with the drivers in the outer group of drivers mounted in an alternating forward and rearward facing manner.

Turning now to FIG. 10, which illustrates one embodiment of a flat audio speaker array 150, the speaker array 150 includes a plurality of common drivers mounted to a generally flat frame 152. As before, the plurality of drivers is electrically connected to operate in common acoustic phase. As shown, an inner group of drivers 154 includes a single driver 156. The single driver 156 is mounted to the frame 152 in a forward facing and generally central manner in a manner known in the art. The outer group of drivers 158 is similarly mounted to the frame 152 in a ring or circular configuration surrounding the inner group of drivers 154. In this embodiment, there are eight drivers in the outer group of drivers 158 mounted to the frame 152 with four forward facing drivers 160 positioned in an alternating manner with four rearward facing drivers 162. In other words, the drivers alternate between forward and rearward facing along the ring or circle as shown.

Figure 11:
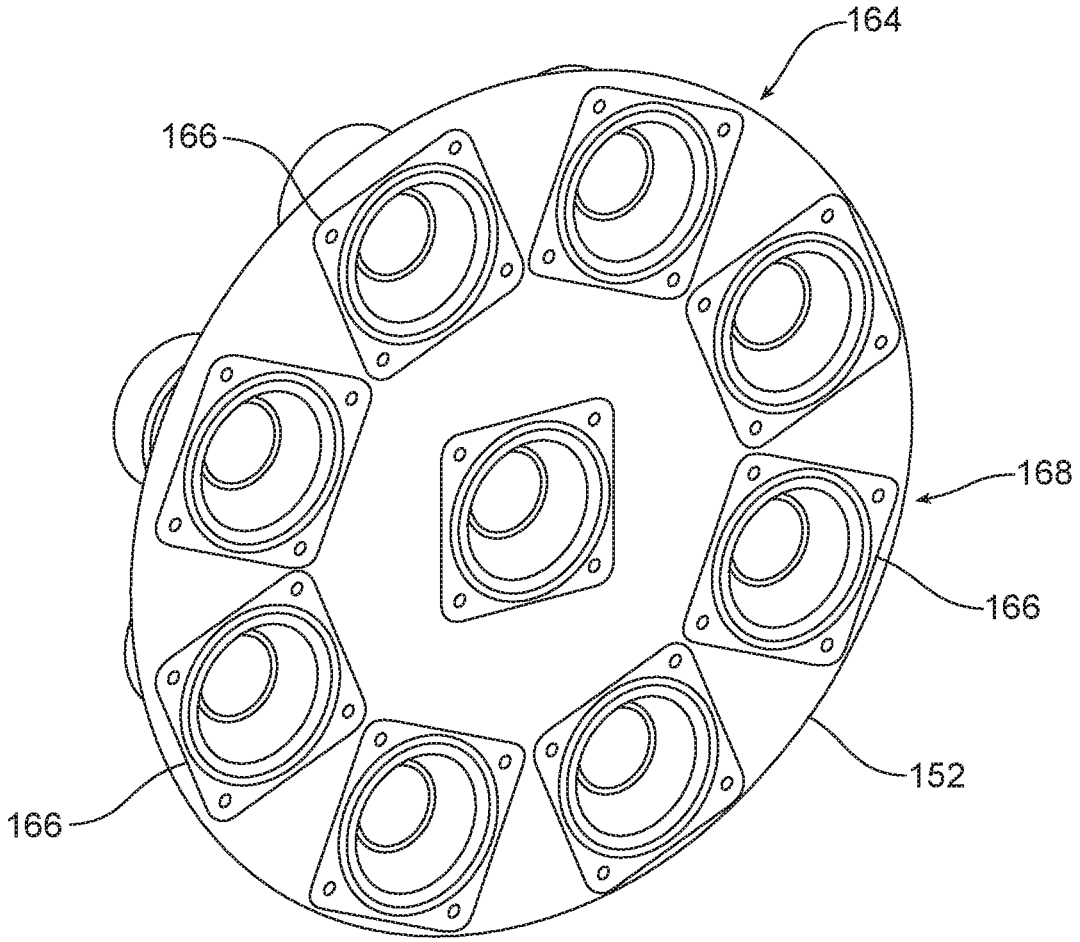
FIG. 11 is a perspective view of an audio speaker array showing a plurality of drivers, including an inner group of driver(s) surrounded by an outer group of drivers, mounted to a generally flat frame with each of the drivers in the inner and outer groups of drivers mounted in a forward facing manner.

A similar embodiment of a speaker array 164 is shown in FIG. 11. In this embodiment, the speaker array 164 is the same as the speaker array 150 except each driver 166 in an outer group of drivers 168 is mounted to the frame 152 in the ring configuration in a forward facing manner as shown. It should also be noted that the speaker arrays illustrated in FIGS. 10 and 11 may be formed with inner, outer and one or more intermediate groups of drivers and the inner group of drivers could include more than one driver.

Although not shown in FIGS. 10 and 11, each embodiment includes a plurality of drivers mounted to a frame having a loading chamber. The loading chamber may take any size or shape and may or may not be loaded with an acoustical transducer such as an additional driver. Mounting the inner and outer groups of drivers to a generally flat frame 152, however, necessarily results in the center points of the drivers forming a planar space rather than the three dimensional space described in previous embodiments wherein each of the drivers is pointing in a different direction and at a different angle relative a plane in the listening space.

As a result, the sonic waves from the outer group of drivers reaches the listener's ears at substantially the same time than does the sonic waves from the inner group of drivers due to flat or planar nature of the frames. As noted above, this issue may be addressed using timing control methods to delay the arrival of sound waves from the outer group of drivers as will be described in greater detail below.

Figure 12:
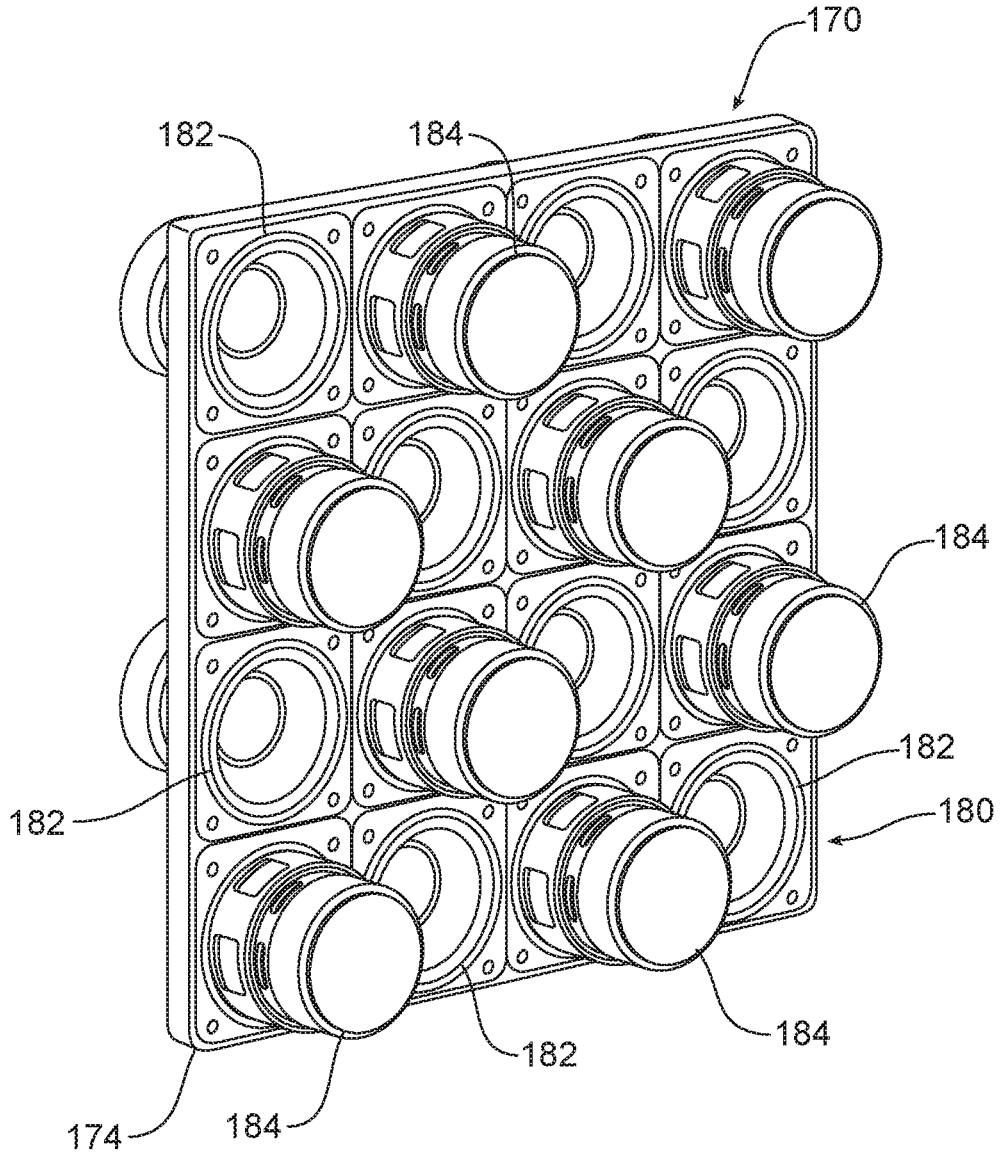
FIG. 12 is a perspective view of an audio speaker array showing a plurality of drivers, including an inner group of driver(s) surrounded by an outer group of drivers, which together form a 4×4 array, mounted to a generally flat frame with the drivers in the inner and outer groups of drivers mounted in an alternating forward and rearward facing manner.

Turning now to FIG. 12, an alternative embodiment of an audio speaker array 170 may similarly include a plurality of common drivers electrically connected to operate in common acoustic phase. As shown, an inner group of drivers 172 includes four drivers mounted to a frame 174 in a generally central manner in a manner known in the art. More specifically, the four drivers are arranged in a 2×2 array including two forward facing drivers 176 and two rearward facing drivers 178 as shown. An outer group of drivers 180 is similarly mounted to the frame 174 and together with the inner group of drivers 172 form a 4×4 array. Other embodiments could use more or fewer drivers in one or both of the inner and/or outer groups in an M×N array. In this embodiment, there are twelve drivers in the outer group of drivers 180 mounted to the frame 174 with six forward facing drivers 182 positioned in an alternating manner with six rearward facing drivers 184. In other words, the drivers alternate between forward facing and rearward facing along the perimeter of the 4×4 array as shown.

Figure 13:
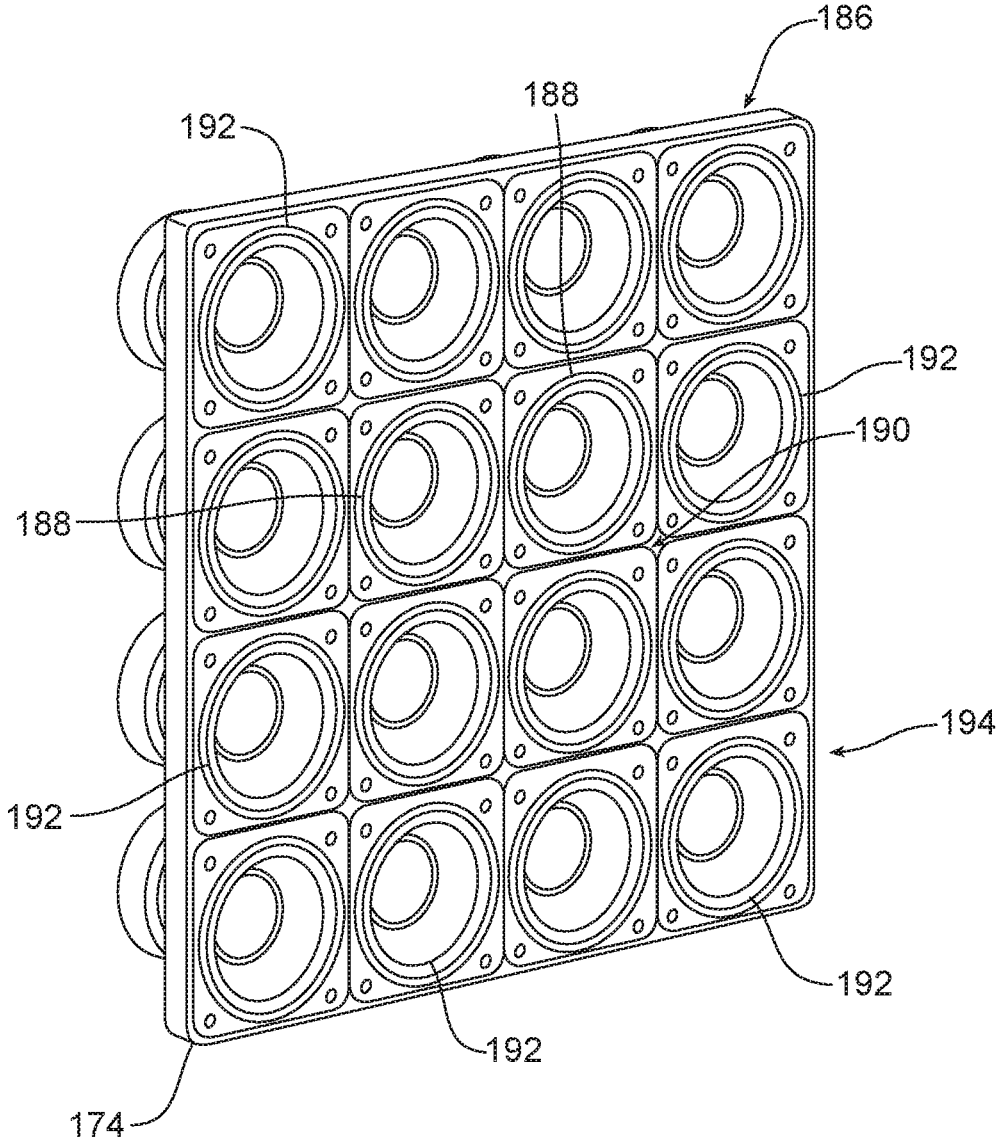
FIG. 13 is a perspective view of an audio speaker array showing a plurality of drivers, including an inner group of driver(s) surrounded by an outer group of drivers, which together form a 4×4 array, mounted to a generally flat frame with each of the drivers in the inner and outer groups of drivers mounted in a forward facing manner.

A similar embodiment of a speaker array 186 is shown in FIG. 13. In this embodiment, the speaker array 186 is the same as the speaker array 170 except each driver 188 in an inner group of drivers 190 and each driver 192 in an outer group of drivers 194 is mounted to the frame 174 in the 4×4 array in a forward facing manner as shown. It should also be noted that the speaker arrays illustrated in FIGS. 12 and 13 may be formed with inner, outer and one or more intermediate groups of drivers and the inner group of drivers could include more than one driver.

Similar to the embodiments shown in FIGS. 10 and 11, each of the M×N array embodiments shown in FIGS. 12 and 13 are mounted to a generally flat frame 174 and include a loading chamber (not shown). The loading chamber may take any size or shape and may or may not be loaded with an acoustical transducer such as an additional driver. Mounting the inner and outer groups of drivers to a generally flat frame 174, however, necessarily results in the center points of the drivers forming a planar space rather than the three dimensional space described in previous embodiments wherein each of the drivers is pointing in a different direction and at a different angle relative a plane in the listening space.

As a result, the sonic waves from the outer group of drivers reaches the listener's ears at substantially the same time than does the sonic waves from the inner group of drivers due to flat or planar nature of the frames. As noted above, this issue may be addressed using timing control methods to delay the arrival of sound waves from the outer group of drivers as will be described in greater detail below.

It is important to note that the configurations shown in FIGS. 12 and 13 provide an advantage over the configurations shown in FIGS. 10 and 11, respectively, due to the greater number of drivers utilized in the arrays, and hence higher SPLs can be achieved utilizing a given frame size.

As noted in the description of the several embodiments of the present invention, certain embodiments utilizing non-planar (e.g., hemispherical, semi-hemispherical, compound angle, etc.) shaped frames naturally create a result where sonic waves from an outer group of drivers reach a listener's ears at a different point in time than sonic waves from an inner group of drivers due to the inner group of drivers being physically closer to the listening space. Of course, this is not the case in the planar or flat frame embodiments described.

Figure 14:
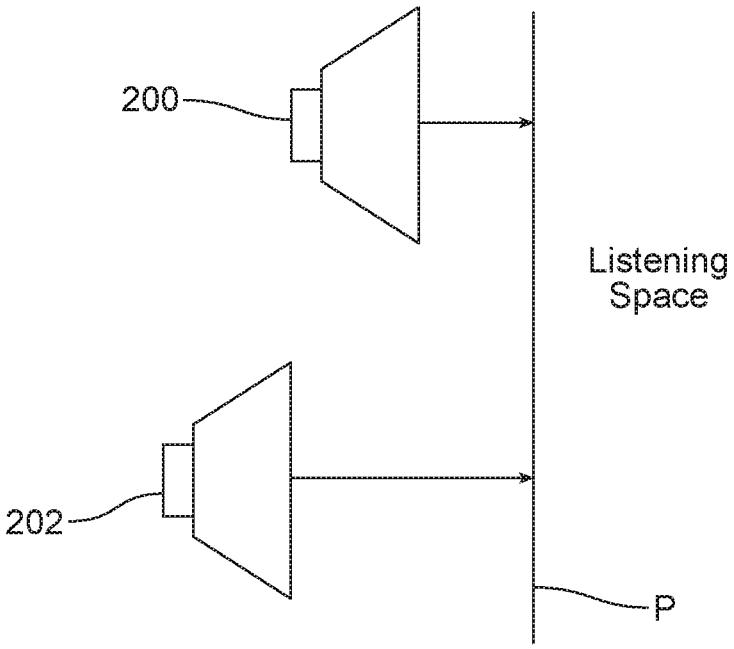
FIG. 14 (PRIOR ART)
FIG. 14 is a schematic diagram showing sound waves radiating from first and second drivers positioned at different distances from a listening space with one sound wave delayed in time such that both sound waves arrive at the listening space at the same time.

Traditionally, the audio industry used time delays to compensate for a driver that is closer to a listening space than other drivers. In other words, convention wisdom holds that control time delays may be used to neutralize sound travel time from transducers in different planes so that the sound waves from all transducers reach the listener's ear at the same time. This is illustrated in FIG. 14 where offset speakers 200, 202 are time aligned with a delay as indicated by the tips of the arrows being in a plane (P) representing a listener's ear in the listening space, for example, where a length of an arrow represents a time duration that a sound wave has traveled. As shown, the front driver 200 is time delayed ensuring the front driver sonic waveform reaches the listening space at the same time as the sonic waveform of the back driver 202. Hence, the tips of the arrows are at plane (P). In such a scenario, the delay in time is equal to the offset distance divided by the speed of sound. The manner of creating such time delays is known in the art utilizing both digital means (e.g., a digital signal processor) and/or analog means.

As noted throughout in the described embodiments, testing reveals that when sonic waves from the outer group of drivers reach the listener's ears at a different point in time than the sonic waves from the inner group of drivers do due to the inner group of drivers being physically closer to the listening space fidelity is improved both on axis and off axis. In other words, the present invention teaches that what was previously thought to be a detractor from fidelity or sound quality can improve sound quality. In addition to the time delay created by the proximity of the inner and outer driver groups to plane (P) in the listening space, additional time delay may be injected into each of the described embodiments to further improve fidelity.

As shown in FIG. 15, for example, where an inner group of driver(s), represented by single driver 204, is closer to a listening space than an outer group of drivers, represented by single driver 206, an additional time delay may be applied to the outer group of drivers. In such a scenario, the sound waves from the outer group of drivers would be delayed beyond the delay created by the proximity of the driver groups to the listening space. This additional time delay may be applied to the outer group of drivers in the planar or flat embodiments described herein in a similar manner. As shown in FIG. 16, for example, where inner and outer groups of drivers, represented by single drivers 208 and 210, respectively, are substantially an equidistance from a plane (P) in the listening space, the additional time delay results in sonic waves from the outer group of drivers reaching the listener's ears at a different point in time than sonic waves from the inner group of drivers. As with the non-planar embodiments, fidelity is improved both on axis and off axis.

The foregoing has been presented for purposes of illustration and description. It is not intended to be exhaustive or to limit the embodiments to the precise form disclosed. Obvious modifications and variations are possible in light of the above teachings. For instance, it is important to note that many aspects of the described embodiments may be utilized with digital or all analog components such as with a turn table, tube amplifiers, and passive filter elements such as capacitors and inductors. Utilizing digital control such as with a digital signal processor does allow more control freedom relative to analog control, but many audio purists prefer a complete analog solution. The described embodiments support either. All such modifications and variations are within the scope of the appended claims when interpreted in accordance with the breadth to which they are fairly, legally and equitably entitled.

What is claimed:

1. An audio speaker for projecting sound into a listening space, comprising:

a frame supporting a plurality of drivers electrically connected to operate in common acoustic phase, the plurality of drivers including an inner group of drivers and an outer group of drivers at least partially surrounding the inner group of drivers and sharing a loading chamber at least partially defined by the frame, wherein the outer group of drivers includes at least two drivers with at least one of the two drivers being a rearward facing driver, and the outer group of drivers and the inner group of drivers are not axially aligned with one another.

2. The audio speaker of claim 1, wherein each of the plurality of drivers is substantially the same size.

3. The audio speaker of claim 1, wherein the inner group of drivers includes at least one rearward facing driver.

4. The audio speaker of claim 3, wherein each of the plurality of drivers is supported by the frame at a unique angle relative to a plane in the listening space.

5. The audio speaker of claim 1, wherein the inner group of drivers includes at least one rearward facing driver and the outer group of drivers includes at least one rearward facing driver.

6. The audio speaker of claim 5, wherein each of the plurality of drivers is supported by the frame at a unique angle relative to a plane in the listening space.

7. The audio speaker of claim 1, wherein each of the plurality of drivers is supported by the frame at a unique angle relative to a plane in the listening space.

8. The audio speaker of claim 1, wherein the frame is flat.

9. The audio speaker of claim 1, wherein the frame is spherical.

10. The audio speaker of claim 9, wherein each of the plurality of drivers is supported by the frame at a unique angle relative to a plane in the listening space.

11. The audio speaker of claim 1, wherein the outer group of drivers is arranged in a circular formation around the inner group of drivers.

12. The audio speaker of claim 1, wherein the plurality of drivers are arranged in an M×N array, wherein N represents the number of drivers in the inner group of drivers and is at least 1 and M represents the number of drivers in the outer group of drivers and is at least 5.

13. The audio speaker of claim 12, wherein the frame is spherical.

14. The audio speaker of claim 1, wherein the inner group of drivers includes a single driver.

15. The audio speaker of claim 1, wherein the plurality of drivers further includes an intermediate group of drivers at least partially surrounding the inner group of drivers.

16. The audio speaker of claim 15, wherein each of the drivers in the intermediate group of drivers is rearward facing.

17. The audio speaker of claim 1, wherein the frame is enclosed by the loading chamber.

18. The audio speaker of claim 1, wherein the loading chamber is loaded with an acoustical transducer.

19. The audio speaker of claim 1, further comprising a loading driver positioned within the loading chamber.

20. The audio speaker of claim 1, wherein each of the drivers in the outer group of drivers is supported by the frame at a greater distance from a plane in the listening space than each of the drivers in the inner group of drivers.

21. The audio speaker of claim 1, wherein each of the drivers in the outer group of drivers is rearward facing.

* * * * *